US010336114B2

(12) United States Patent
Courtney et al.

(10) Patent No.: US 10,336,114 B2
(45) Date of Patent: Jul. 2, 2019

(54) METHOD OF FLEXOGRAPHIC PRINTING OVER A TEXTURED SURFACE

(71) Applicant: Steelscape, LLC, Kalama, WA (US)

(72) Inventors: Shelby Leigh Courtney, Kelso, WA (US); Jonathan Charles King, Longview, WA (US); Marc Eric Fullem, Greensburg, PA (US)

(73) Assignee: STEELSCAPE, LLC, Kalama, WA (US)

( * ) Notice: Subject to any disclaimer, the term of this patent is extended or adjusted under 35 U.S.C. 154(b) by 96 days.

(21) Appl. No.: 15/493,375

(22) Filed: Apr. 21, 2017

(65) Prior Publication Data

US 2018/0056688 A1 Mar. 1, 2018

Related U.S. Application Data

(60) Provisional application No. 62/382,721, filed on Sep. 1, 2016.

(51) Int. Cl.

| | |
|---|---|
| ***B41F 5/04*** | (2006.01) |
| ***B41F 5/24*** | (2006.01) |
| ***B41M 1/04*** | (2006.01) |
| ***B41M 1/40*** | (2006.01) |
| ***B41F 17/00*** | (2006.01) |
| ***B41F 23/00*** | (2006.01) |

(52) U.S. Cl.

CPC ..... *B41M 1/04* (2013.01); *B41F 5/04* (2013.01); *B41F 5/24* (2013.01); *B41F 17/006* (2013.01); *B41F 23/002* (2013.01); *B41F 23/005* (2013.01); *B41F 23/007* (2013.01); *B41M 1/40* (2013.01); *B41P 2200/12* (2013.01)

(58) Field of Classification Search

CPC ... B41M 1/04; B41M 1/40; B41F 5/04; B41F 5/24; B41F 17/006; B41F 23/002; B41F 23/005; B41F 23/007; B41F 19/001; B41F 19/00

See application file for complete search history.

(56) References Cited

U.S. PATENT DOCUMENTS 6,343,550 B1 * 2/2002 Feesler ..... B41F 5/24 101/375

6,899,029 B2 5/2005 Invernizzi (Continued)

FOREIGN PATENT DOCUMENTS

JP 06296932 A * 10/1994

OTHER PUBLICATIONS

Chemetall, Kleen 4010 Technical Information, dated Mar. 0, 2008.

(Continued)

*Primary Examiner* — David H Banh

(74) *Attorney, Agent, or Firm* — Lathrop Gage L.L.P.

(57) ABSTRACT

Disclosed herein is a method for flexographically printing over a textured surface. The method comprises selecting a substrate for application of a print pattern and advancing the substrate through a flexographic coil paint line in order to apply a primer to at least one side of the substrate. Next a finish coat is flexographically applied to the primed substrate and due to a chemical reaction of the applied finish coat along with supplemental heating, the finish coat forms a textured surface. Next, a print pattern is flexographically applied atop the textured surface.

20 Claims, 5 Drawing Sheets

(56) References Cited

U.S. PATENT DOCUMENTS

| | | | | |
|---|---|---|---|---|
| 7,279,225 | B2 * | 10/2007 | Velliky | B29C 47/0021 427/209 |
| D608,474 | S | 1/2010 | Metcalf et al. | |
| D621,068 | S | 8/2010 | Goodson et al. | |
| 2002/0114884 | A1 * | 8/2002 | Friedersdorf | B05D 7/14 427/195 |
| 2003/0140805 | A1 | 7/2003 | Hertzog | |
| 2003/0152788 | A1 * | 8/2003 | Velliky | B29C 47/0021 428/461 |
| 2006/0234396 | A1 * | 10/2006 | Tomita | B82Y 10/00 438/3 |
| 2009/0061177 | A1 * | 3/2009 | Kriha | B41F 5/24 428/209 |
| 2009/0133782 | A1 * | 5/2009 | Uchida | C23C 18/1601 148/275 |
| 2011/0222178 | A1 * | 9/2011 | Bruchmann | G02B 26/06 359/848 |
| 2012/0171500 | A1 * | 7/2012 | Chang | C23C 14/021 428/457 |
| 2014/0109783 | A1 | 4/2014 | Queen et al. | |
| 2014/0127498 | A1 * | 5/2014 | Ibanez | C09D 5/002 428/336 |
| 2015/0140338 | A1 * | 5/2015 | Morris | C23C 22/83 428/413 |
| 2016/0067739 | A1 * | 3/2016 | Jones | A61M 5/3287 604/507 |

OTHER PUBLICATIONS

Chemetall, Permatreat 1500 Process Technical Information, dated May 0, 2010.

Becker's Industrial Coatings, www.beckers-group.com/our-business/industrial-coatings/, dated Jun. 21, 2017.

* cited by examiner

METHOD OF FLEXOGRAPHIC PRINTING OVER A TEXTURED SURFACE

CROSS REFERENCE TO RELATED APPLICATION

This application claims the benefit of priority to U.S. Application No. 62/382,721 filed on Sep. 1, 2016.

TECHNICAL FIELD

This disclosure relates to a method for producing a flexographic printed product that consists of a primer coating, a textured base coating and one or more print coatings applied to a substrate to achieve a desired appearance.

BACKGROUND

Frequently used for printing on plastic, foil, acetate film, brown paper, and other materials, flexography or flexographic printing uses flexible printing plates made of rubber or plastic. The coated plates with a slightly raised image are rotated on a cylinder which transfers the image to the substrate. Flexography uses fast-drying coatings, is a high-speed print process, can print on many types of absorbent and non-absorbent materials, and can print continuous patterns (such as for giftwrap and wallpaper). A typical application for flexography is for printing on metal substrates; however, the implementation of a flexographic process that has proven particularly elusive is to flexographically apply a print, for example, a patterned print over a textured surface.

Application of a precisely defined print over a textured surface has proven difficult to accomplish because of the multitude of factors that are implicated in the production process including factors such as coil line speed, the viscosity of the primer and the coating used to create the desired print pattern as well as pressure applied to the metal coil passing through the coating line and the pressure applied to the pick-up roll and the applicator roll.

SUMMARY

The technology disclosed herein is for a printing process that employs the use of pliable relief or raised image plates. Flexography can be used to print on nearly any substrate whether paper products, metallic or holographic films and foils, or plastic of all types. Flexography is often used to print large areas with solid colors. Another reason flexography is so widely used is that it adapts well to both irregular repeat lengths and to a comprehensive array of coatings.

A flexographic print is made by creating a positive mirrored master of the required image as a 3-dimensional relief in a rubber or polymer material. Flexographic plates can be created with analog and digital platemaking processes. The image areas are raised above the non-image areas on the rubber or polymer plate. The coating is transferred from the pickup roll which is partially immersed in the coating pan to the anilox or ceramic roll (or meter roll) which assists in metering the coating transfer to the print sleeve in a uniform thickness evenly and quickly (the number of cells per linear inch can vary according to the type of print job and the quality required).

To avoid a final product with a smudgy or lumpy look, the amount of coating on the print sleeve must not be excessive. The metering roll removes excess coating from the pickup roll thereby allowing a very precise, or metered amount of coating to be transferred to the print sleeve. In accomplishing the transfer of the coating to the substrate, the substrate is sandwiched between the print sleeve of the applicator roll and the backup drum to transfer the image. The sheet is then fed through a dryer, which allows the coatings to dry before the surface is touched again. If a UV-cure coating is used, the sheet does not have to be dried, as the coating is cured by UV rays instead.

The process disclosed herein produces a flexographic printed product that consists of a primer coating, textured base coating, and one or more print coatings applied over the textured coat to achieve a desired appearance. The disclosed process relies upon extensive testing of multiple parameters to arrive at a product that is capable of providing long term resistance to weathering and provide an aesthethically appealing appearance.

Various objects, features, aspects and advantages of the disclosed subject matter will become more apparent from the following detailed description of preferred embodiments, along with the accompanying drawings in which like numerals represent like components. The contents of this summary section are provided only as a simplified introduction to the disclosure, and are not intended to be used to limit the scope of the appended claims.

The contents of this summary section are provided only as a simplified introduction to the disclosure, and are not intended to be used to limit the scope of the appended claims.

DEFINITIONS

NIP pressure—is the pressure between two rollers that are forced together.

KISS pressure—is the minimum pressure required to produce the proper coating transfer from the print sleeve on the applicator roller to the substrate.

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims Flexography is a form of a printing process which utilizes a flexible relief plate. A unique ability of flexography is that it is capable of printing a continuous image of various repeat lengths by means of a design roll. A design roll is an engraved roll with a continuously repeating image around its circumference.

Figure 1:
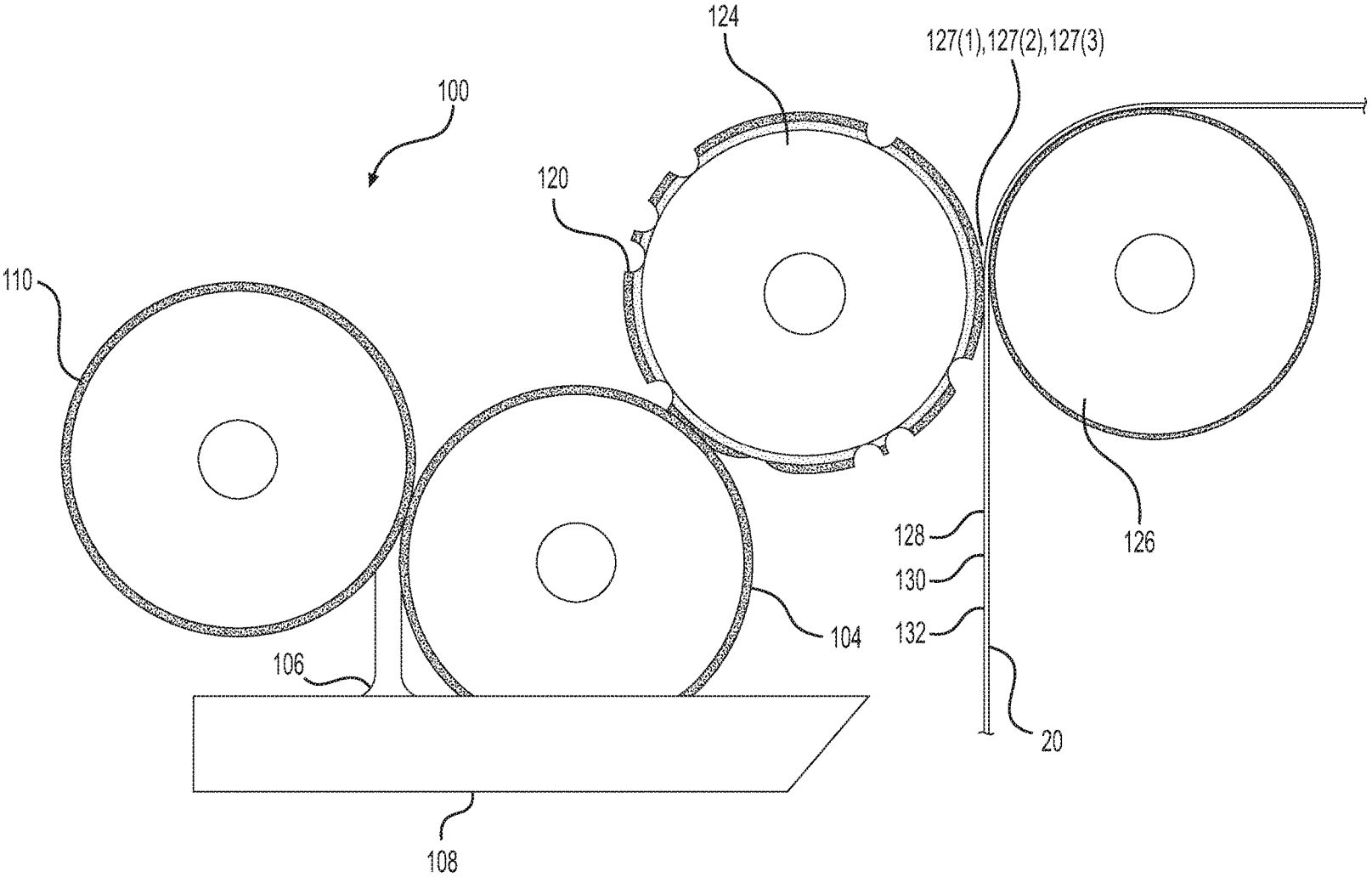
FIG. 1 depicts an embodiment of an exemplary flexographic print system.

As shown in FIG. 1, a flexographic printing system 100 is essentially a modern version of a letterpress which can be used for printing on almost any type of substrate. The flexographic system 100 is widely used for printing on non-porous substrates 20 required for various types of materials, for example, food packaging. It is also well suited for printing large areas of solid color such as in the instant application. In a standard flexographic operation the pick-up roller 104 transfers the coating 106 that is located in the coating pan 108 to the second roller which is the anilox roller or "metering" roller 110.

As further shown in FIG. 1, the pick-up roller 104, which is generally rubber-covered, picks up a thick film of coating 106 and transfers it to a metering roller 110, also known in flexography as an anilox roller. The metering roller is a chrome or ceramic covered roller whose surface contains small, engraved pits or cells (typically from 80 to 1,000 cells per inch). The pressure between the pick-up roller 104 and the metering roller 110 is set so that the excess coating is squeezed from the line contact between them. The goal is to ensure that only the metered coating stored in the rubber covering of the pick-up roll 104 is transferred to the flexible rubber relief plate or print sleeve 120 of the applicator roll 124.

After the cells of the pick-up roller 104 are filled with coating 106, the coating 106 is metered by the metering roller 110. On some presses, the metering roller 110 is the only roller in the coating system, rotating in the coating pan 108 and delivering a coating 106 directly to the print sleeve 120 on the applicator roll 124. On other presses, the pick-up roller 104 delivers coating from the coating pan 108 to the metering roller 110 before the pick-up roll 104 unloads coating 106 to the flexible sleeve 120 of the applicator roll 124. The substrate 20 passes between the print sleeve 120 of the applicator roll 124 and the backup drum with coating applied by print sleeve 120. As discussed above, FIG. 1 details the flexographic coating applicator hardware 104, 110, 120, 124, 126 of the coating line 100 through which the substrate 20 passes wherein the applicator roll 124 is responsible for applying 127(1) a pretreatment 128 coat to the substrate 20 as well as for applying 127(2) a primer coat 130 atop the pretreatment coat and also applying 127(3) to the primed substrate a finish coat 132 with the at least one coating system 100. This application of coatings 128, 130 and 132 may require passing the substrate 20 multiple times through a single coating line 100 or the utilization of multiple sequentially disposed coating lines 100 through which the substrate 20 passes but one time to achieve application of all coatings.

The nature and demands of the printing process and the application of the printed product determine the fundamental properties required of flexographic coatings. Measuring the physical properties of coatings and understanding how these are affected by the choice of ingredients is a large part of coating technology. Formulation of coatings requires a detailed knowledge of the physical and chemical properties of the raw materials composing the coatings, and how these ingredients affect or react with each other as well as with the substrate. Flexographic printing coatings are primarily formulated to remain compatible with the wide variety of substrates used in the process. Each formulation component individually fulfills a special function and the proportion and composition will vary according to the substrate.

There are generally five types of coatings that can be used in flexography: solvent-based coatings, water-based coatings, electron beam curing coatings, ultraviolet curing coatings and two-part chemically-curing coatings (usually based on polyurethane isocyanate reactions), although these are less common. The coating is controlled in the flexographic printing process by the coating unit.

Flexographic coatings 106 are subject to evaporation, resulting in changes in viscosity and pH, making it necessary to monitor, adjust and test the coating before printing and during the press run. Coating viscosity—resistance to flow—is measured using a viscosity measurement cup, or efflux cup. The most common is the #4 Zahn cup, a small metal cup attached to a long handle with a precisely-sized small hole drilled in the bottom. By dipping the cup in the coating and measuring in seconds the amount of time it takes for the coating to empty through the hole, the operator can evaluate viscosity. The longer it takes for the Zahn cup to empty, the higher the viscosity of the coating. If the coating viscosity is too high, the coating needs to be thinned using water or solvent. Once viscosity is controlled, an electronic pH meter is used to verify that the coating is within the specified target pH range, usually between 8.0 and 9.5, or slightly alkaline, in the case of water-based coatings. Proper pH control is necessary to ensure proper laydown and drying of the coating.

Figure 2:
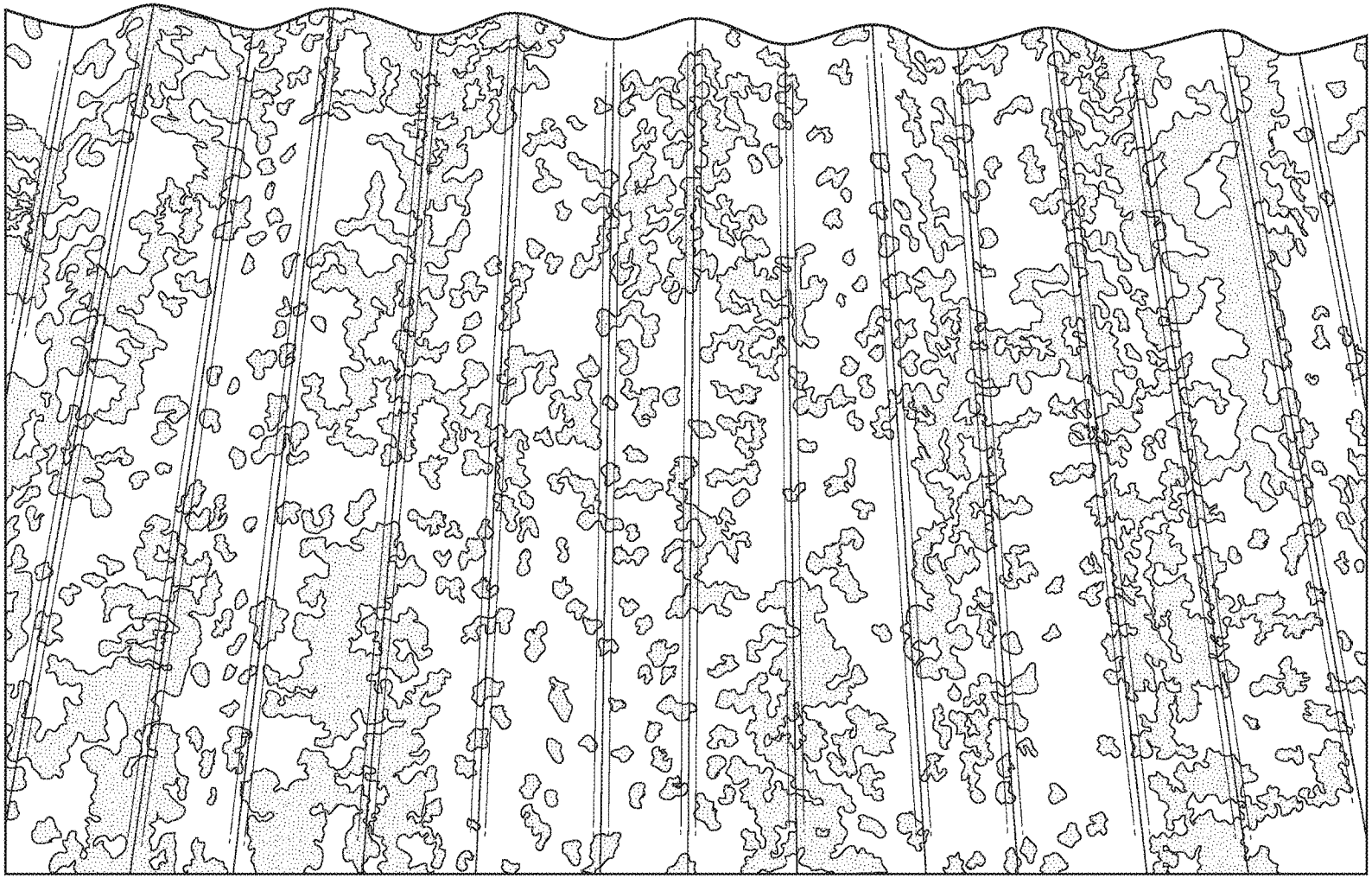
FIG. 2 depicts an embodiment of an exemplary corrugated metal panel displaying the flexographically applied coatings with a pattern.
Figure 3:
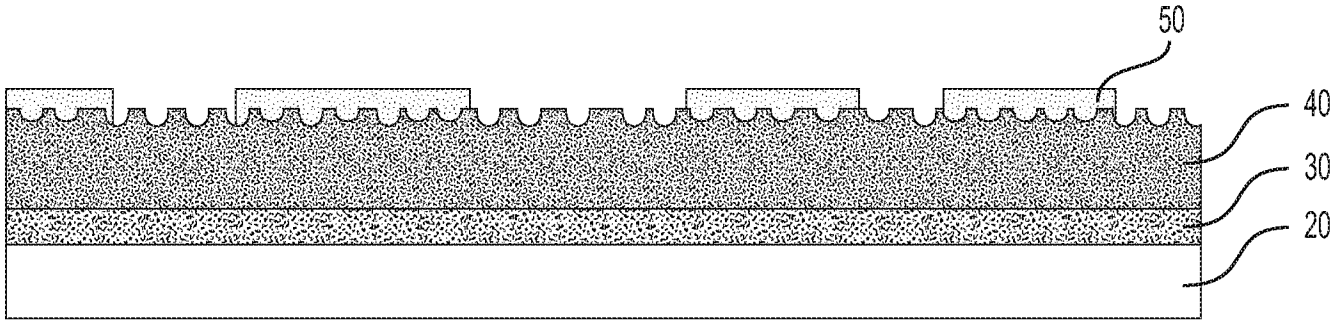
FIG. 3 depicts a cross-sectional elevation view of the layers applied by the flexographic process.

FIG. 2 depicts an embodiment of a roll formed corrugated metal panel with the application of a rust pattern over a textured under layer. The embodiment detailed in FIG. 3 is representative of the output of the process disclosed herein but is just a single example of the many patterns that may be applied to a substrate capable of undergoing the herein disclosed flexographic printing method. The panel depicted in FIG. 2 was fabricated from a flat panel and the coating is applied as disclosed herein and then roll forming of the panel creates the corrugations in the panel.

FIG. 3 is a cross-sectional elevation view of the layers of coatings that are applied using the above disclosed flexographic equipment and the process sequence as described below. The substrate layer 20 is preferably a then steel or aluminum rolled sheet material. The first coating applied atop the substrate is a primer coat 30 that is applied to facilitate adherence of the textured layer 40 to the substrate layer 20. An exemplary primer is produced by Becker's Industrial Coatings; however, primers from other vendors may be utilized to provide the desired level of adherence and durability. Positioned atop the primer coat 30 is the rawhide texture layer 40. The textured layer 40 is applied, as with the primer layer by flexographic rollers as described above. The textured layer 40 is a coating composition that is applied through reverse roll coating, a flexographic process that is well known within the industry. The rust print layer 50 positioned atop the textured layer 40 is applied following the application of the textured layer 40 during a second pass through the coil coating line.

The method of fabricating the flexographically coated substrate, or metal coil, requires many production parameters to be precisely controlled to achieve the desired visual effect and long term durability of the coated substrate 20. In operation, the leading edge of a metal coil weighing in the range of from 20,000 to 40,000 pounds and comprised of either aluminum or steel, of a thickness typically between 0.010 and 0.070 inches with a width typically between 20 and 60 inches is introduced into the feed end of the coil coating line. These coils range from about 5,000 feet to about 10,000 feet in length and are unspooled by the coil coating line at speeds that can approach 250 feet per minute.

Figure 4:
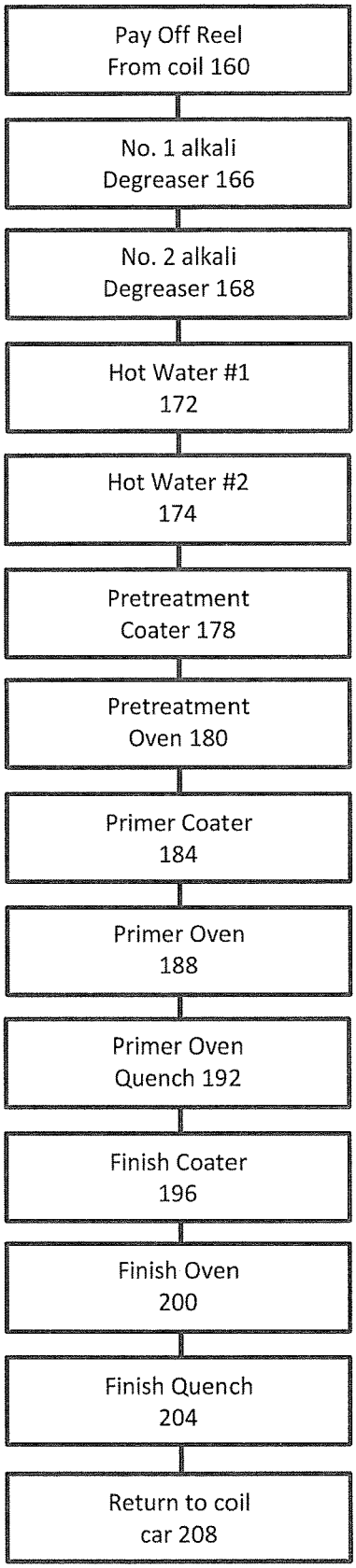
FIG. 4 is a process flow diagram for the first pass of a base metal through the coating line.

The substrate 20 passes through multiple operations in two separate passes through the coil coating line to achieve the desired final appearance and weatherability. FIG. 4 provides a process flow diagram of the coating line processes in the first pass to include loading of the coil (base metal/substrate 20) onto the coating line 156 from the payoff coil 160 and into the first and second alkali degreasers 166, 168. The objective of the alkali degreasing stations is to remove oily residue that could prevent optimal adherence of the primer 30 and utilizes a multi-metal degreaser such as ChemetallKleen 4010. Upon exiting the second alkali degreaser 168 the base metal 20 advances to the first and second hot water rinse stations 172, 174. After exiting the second hot water rinse 174, the base metal 20 passes into the pretreatment coater 178 where a pretreatment solution, such as, Permatreat® 1500 produced by Chemetall with an office in Jackson, Mich., is used to assist the primer 30 in adhering to the substrate 20. Other metal pretreatment materials may also be employed as appropriate to the meet the specifications of the process. The coating process in the pretreatment coater 178 occurs at ambient temperature and the pretreatment material is rolled onto the substrate utilizing the print sleeve 120 of an applicator roll 124.

After exiting the pretreatment coater 178 the substrate 20 traverses to the pretreatment oven 180 which raises the temperature of the substrate and applied pretreatment to approximately 300° F. The substrate 20 has only a short residence time in the pretreatment oven 180 sufficient to quickly evaporate the pretreatment materials from the surface of the substrate 20. The substrate 20 then traverses to the primer coater 184 which is applies the primer 30 in a manner as described above with the substrate 20 passing between an applicator roll 124 with a print sleeve 120 and a backup drum 126.

Upon exiting the primer coater 184, the substrate 20 enters a primer oven 188 where the substrate 20 and applied primer 30 achieve a peak metal temperature of 435° F. in order to volatilize solvents or evaporate water from the preferred primer 30. The substrate 20 and adhered primer 30 have a residence time of approximately 48 seconds as they traverse through the primer oven 188. Oven residence times, peak metal temperature parameters may vary depending upon primer compositions, substrate dimensions and other operational parameters.

Once the primed substrate exits the primer oven 188, the material enters the primer oven quench 192 which is comprised of several sequentially disposed spray bars that cool the primed substrate with multiple shower heads dispensing cooling water to lower the substrate temperature to well below the peak metal temperature of 435° F. achieved within the primer oven 188.

As the primed substrate exits the primer oven quench 192 it traverses to a finish coater 196 which is a two roll application process. The two rolls apply a coating at a temperature of about 90° F. with a viscosity of 18-22 seconds measured with a #4 Zahn cup. The coating is applied to the primed substrate with a preferred thickness of between 0.70 and 0.80 mils, the thickness being controlled by adjustment of the NIP pressure measured at the interface between the applicator roll 124 and the backup drum 126.

Once the primed substrate 20 exits the finish coater 196 it advances to a finish oven 200 where the primer and finish coated substrate reaches a peak metal temperature in the range of 450°-480° F. The primed and finish coated substrate experiences an in-oven residence time of approximately 48 seconds in order to volatilize solvents from the resin of the applied finish coat. At the elevated peak metal temperature in the oven, the just applied finish coat undergoes a chemical reaction, or alternatively a curing of the finish, resulting in a finish when dried and cooled with a roughness readily perceptible to the human touch.

Upon exiting the finish oven 200 the primed and finished substrate progresses toward the finish quench 204 which is comprised of several sets of spray bars that shower the primed and finished substrate 20 with water near ambient room temperature to quickly lower the temperature of the substrate and applied coatings to near ambient temperature. As discussed above, the cooled finish coat has a roughness readily perceptible to the human touch. Once the primed and finished substrate exits the finish quench 204 it is coiled on a coil car 208 thereby completing the first pass through the coating line. The coating coil is now ready for a second pass through the coating line to add one or more layers of coating to complete the coating application process.

Figure 5:
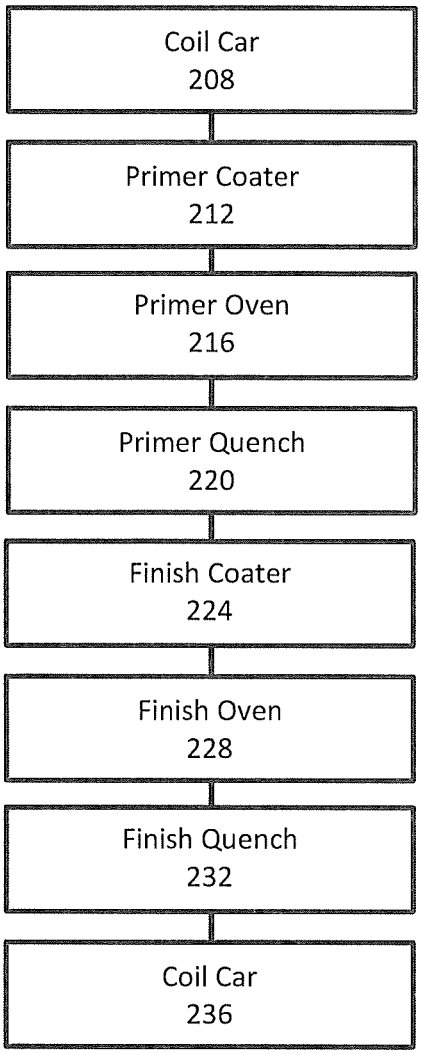
FIG. 5 is a process flow diagram for the second pass of a base metal through the coating line.

The coil car 208 along with the coiled substrate 20 is moved into position to reenter the coating line for a second pass to add one, or more, additional coating layers to the existing layers. FIG. 5 details an exemplary process flow diagram for a second pass through the coating line. As the substrate 20 and applied primer and finish coat are uncoiled from the coil car 208 the metal and previously applied coatings move to the primer coater 184 where a second primer coat is applied atop the finish coat applied during the previous pass through the coating line. In a preferred embodiment of the final product, a primer coat is not applied to the previously applied finish coat. The preferred embodiment of the coated substrate 20, as shown in FIG. 3 includes a print pattern 50 over the textured finish coat 40. The print pattern 50 is applied as previously discussed by passing the substrate 20 and previously applied primer 30 and textured finish coat 40 between an applicator roll 124 with an applied print sleeve 120 and a backup drum 126. Other embodiments of the finished product may; however, require the application of one or more primer coats along with one or more finish coats. The print pattern is transferred to the textured finish coat utilizing a pattern on the roller that is specially designed to achieve the desired pattern appearance.

In the preferred embodiment, the print 50 is preferably between 0.3-0.4 mils in thickness and is applied atop the rawhide texture coat 40, applied in the first pass through the coating line. The print 50 is applied with a print sleeve 120 circumscribing an applicator roller 124 wherein the substrate 20 passes between the applicator roller 124 and the backup drum 126. After traversing between the applicator rolls 124, 126 which apply the print 50, the substrate 20 and applied coatings traverse to the finish oven 228 and are heated to a peak metal temperature of 445° F. with a residence time of approximately 48 seconds, an amount of time sufficient to volatilize organic compounds or excess water resident within the coating.

Exiting the oven 228, the substrate and applied coatings of the preferred configuration traverse to an oven quench 232 where a multitude of spray bars shower the metal substrate 20 and applied coatings with water to cool the metal and coatings to near ambient temperatures. Upon exiting the oven quench 232 the preferred embodiment of the substrate with the print upper coating is rewound upon the coil car 236 and is ready for shipment.

For embodiments other than the preferred, following the first pass through the coating line, the substrate and applied coatings will enter the coating line again for a second pass. The second pass will include the application of a second primer coat as detailed above with passage of the substrate 20 and previously applied coatings through the applicator rolls 124, 126 in the primer coater 212. Upon exiting the primer coater 212, the substrate and applied coatings traverse to the primer oven 216 wherein the substrate and coatings are heated to a peak metal temperature of about 435° F. with a dwell time of about 48 seconds. Upon exiting the primer oven 216 the substrate 20 and applied coatings traverse to the primer quench 220 where spray bars deluge the heated metal substrate 20 and coatings with water rapidly dropping the temperature of the coated metal.

Following the quench operation 220, the twice primed and once finish coated substrate enters the finish coater 224 which passes the primed and finish coated substrate between an applicator roll 124 with a print sleeve 120 and a backup drum 126 as previously described for application of a finish coat which may optionally be supplied by, for example, Beckers Industrial Coatings. Coatings from other vendors may also be employed.

The temperature of the applied coating is preferably about 90° F. and the viscosity of the applied coating is preferably measured at about 22 seconds using a #4 Zahn cup. Upon exiting the finish coater 224 the twice primed and twice finish coated substrate 20 enters the finish oven 228 which is heated to a peak metal temperature of 465° F. with a residence time of approximately 48 seconds, an amount of time sufficient to volatilize the organic compounds or excess water resident within the second finish coat.

After departing the finish oven, the substrate and applied coating layers experience a finish quench 232 with several spray bars showering the substrate and applied coatings with water to lower the peak metal temperature to roughly ambient room temperature. Upon exiting the finish quench 232 the substrate and applied coatings are in their final saleable form and are returned to a coiled configuration and retained upon a coil car 236.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings. Moreover, the order of the components detailed in the system may be modified without limiting the scope of the disclosure.

We claim:

1. A method for flexographically printing over a textured surface, the method comprising:

feeding a substrate into a coating line with at least one coating system, the coating system further comprising at least one each of i) a coating pan, ii) a pick-up roll, iii) a metering roll, iv) an applicator roll, v) a print sleeve circumscribing the applicator roll, and vi) a backup drum, wherein the substrate traverses between the print sleeve and the backup drum;

degreasing the substrate at a degreasing station;

rinsing the substrate at a rinsing station;

applying a pretreatment coat to the substrate with the at least one coating system;

heating the pretreatment coated substrate;

applying to the substrate a primer coat, having a viscosity as determined by an efflux time of about 22 seconds while utilizing a number 4 Zahn cup, with the at least one coating system;

heating the primed substrate to a temperature in the range of from about 430° to 440° F.;

quenching the primed substrate;

applying to the primed substrate a finish coat, having a viscosity as determined by an efflux time of about 22 seconds while utilizing a number 4 Zahn cup, with the at least one coating system;

heating the primed and finish coated substrate to a temperature in the range of from about 445° to 455° F.;

quenching the primed and finish coated substrate;

returning the primed and finish coated substrate to a coil form on a coil car;

refeeding the primed and finish coated substrate into the coating line from the coil car;

applying a second primer coat to the primed and finish coated substrate;

heating the twice primed and finish coated substrate to a temperature in the range of from about 445° to 455° F.;

quenching the twice primed and finish coated substrate;

applying a second finish coat to the twice primed and once finish coated substrate;

heating the twice primed and twice finish coated substrate to a temperature in the range of from about 445° to 455° F.;

quenching the twice primed and twice finish coated substrate; and returning the twice primed and twice finish coated substrate to a coil form on a coil car.

2. The method of claim 1, wherein the degreasing step further comprises a solution with a free alkalinity in the range of 4-6 pH.

3. The method of claim 1, wherein the degreasing step further comprises a solution with a total alkalinity in the range of 8-12 pH.

4. The method of claim 1, wherein the degreaser is metal cleaner.

5. The method of claim 1, wherein the pretreatment is a multi-metal pretreatment for architectural applications.

6. The method of claim 1, wherein the water temperature during the step of quenching the primed substrate is in the range of about 135° to 145° F.

7. The method of claim 1, wherein the water temperature during the step of quenching the primed and finish coated substrate is in the range of about 135° to 145° F.

8. The method of claim 1, wherein the water temperature during the step of quenching the twice primed and finish coated substrate is in the range of about 125° to 135° F.

9. The method of claim 1, wherein the water temperature during the step of quenching the twice primed and twice finish coated substrate is in the range of about 115° to 125° F.

10. The method of claim 1, wherein the substrate comprises a metal.

11. The method of claim 10, wherein the metal is steel.

12. The method of claim 1, wherein the step of applying to the substrate a primer coat further comprises the primer having an efflux time of about 22 seconds while utilizing a number 4 Zahn cup.

13. The method of claim 1, wherein the step of applying to the primed substrate a finish coat, the finish coating has an efflux time of about 22 seconds utilizing a number 4 Zahn cup.

14. The method of claim 1, wherein the print sleeve is comprised of a polymer material.

15. A method for flexographically printing over a textured surface, the method comprising:

selecting a substrate for application of a print pattern;

advancing the substrate into a coating line;

applying a primer, to the substrate as the substrate passes through the coating line, wherein the primer is applied by a primer coating system and has a viscosity as determined by an efflux time of about 22 seconds while utilizing a number 4 Zahn cup and heating the primed substrate to a temperature in the range of from about 430° to 440° F.;

heating the primer coat and substrate;

applying a finish coat, the finish coat having a viscosity as determined by an efflux time of about 22 seconds while utilizing a number 4 Zahn cup, to the primed substrate as the primed substrate passes through the coating line, wherein the finish coat is applied by a finish coating system;

heating the primed substrate and applied finish coat to facilitate curing of the finish coat resulting in a textured appearance to the finish coat;

removing the primed and finish coated substrate from the coating line;

returning the primed and finish coated substrate to the coating line;

applying a print, having a viscosity as determined by an efflux time of about 22 seconds while utilizing a number 4 Zahn cup, over the finish coat with a textured appearance and heating the primed and finish coated substrate to a temperature in the range of from about 445° to 455° F., wherein the print is applied by a print coating system; and removing the primed, finish coated and print coated substrate from the coating line.

16. The method of claim 15, wherein the primer coating system is comprised of at least one each of i) a coating pan, ii) a pick-up roll, iii) a metering roll, iv) an applicator roll, v) a print sleeve circumscribing the applicator roll, and vi) a backup drum, wherein the substrate traverses between the applicator roll surrounded by the print sleeve and the backup drum.

17. The method of claim 15, wherein the finish coating system is comprised of at least one each of i) a coating pan, ii) a pick-up roll, iii) a metering roll, iv) an applicator roll, v) a print sleeve circumscribing the applicator roll, and vi) a backup drum, wherein the substrate traverses between the applicator roll surrounded by the print sleeve and the backup drum.

18. The method of claim 15, wherein the print coating system is comprised of at least one each of i) a coating pan, ii) a pick-up roll, iii) a metering roll, iv) an applicator roll, v) a print sleeve circumscribing the applicator roll, and vi) a backup drum, wherein the substrate traverses between the applicator roll surrounded by the print sleeve and the backup drum.

19. The method of claim 15, wherein the application of the primer, finish coat and print coat over the substrate emulates a rusted steel appearance.

20. The method of claim 15, wherein the primer coating system maintains a kiss pressure of about 130 psi and a nip pressure of about 700 psi.

* * * * *